US011843196B2

(12) United States Patent
Papageorge et al.

(10) Patent No.: US 11,843,196 B2
(45) **Date of Patent: *Dec. 12, 2023**

(54) ELECTRICAL CONNECTOR AND SLEEVE FOR ELECTRICAL CONTACT

(71) Applicant: Hubbell Incorporated, Shelton, CT (US)

(72) Inventors: Ryan Papageorge, Shelton, CT (US); Thomas Scanzillo, Monroe, CT (US); Christopher Carbone, Newton, CT (US); Thomas McLean, Milford, CT (US)

(73) Assignee: Hubbell Incorporated, Shelton, CT (US)

( * ) Notice: Subject to any disclaimer, the term of this patent is extended or adjusted under 35 U.S.C. 154(b) by 251 days.

This patent is subject to a terminal disclaimer.

(21) Appl. No.: 17/325,773

(22) Filed: May 20, 2021

(65) Prior Publication Data

US 2021/0273366 A1 Sep. 2, 2021

Related U.S. Application Data

(63) Continuation of application No. 16/734,696, filed on Jan. 6, 2020, now Pat. No. 11,024,999, which is a continuation of application No. 15/919,931, filed on Mar. 13, 2018, now Pat. No. 10,530,088.

(60) Provisional application No. 62/470,516, filed on Mar. 13, 2017.

(51) Int. Cl.

| | |
|---|---|
| ***H01R 13/424*** | (2006.01) |
| ***H01R 43/20*** | (2006.01) |
| ***H01R 13/58*** | (2006.01) |
| ***H01R 13/506*** | (2006.01) |

(52) U.S. Cl.
CPC ..... *H01R 13/424* (2013.01); *H01R 13/506* (2013.01); *H01R 13/5825* (2013.01); *H01R 43/20* (2013.01)

(58) Field of Classification Search
CPC ..... H01R 12/58; H01R 12/75; H01R 13/426; H01R 13/502; H01R 13/506; H01R 13/516; H01R 13/5285; H01R 13/58; H01R 13/64; H01R 43/20; H01R 2103/00
See application file for complete search history.

(56) References Cited

U.S. PATENT DOCUMENTS

| | | | |
|---|---|---|---|
| 3,681,742 | A | 8/1972 | Newman |
| 4,010,993 | A | 3/1977 | Hohenberger et al. |
| 4,108,527 | A | 8/1978 | Douty |

(Continued)

OTHER PUBLICATIONS

PCT/US2018/022194 International Search Report and Written Opinion dated Jun. 14, 2018.

(Continued)

*Primary Examiner* — Oscar C Jimenez
(74) *Attorney, Agent, or Firm* — Robinson & Cole LLP

(57) ABSTRACT

A stage pin electrical connector includes a housing having a first housing member and a second housing member. The first and second housing members are releasably connected together to define an interior, a conductor opening, a contact portion, and a contact opening. The contact portion includes a first snap-fit connection feature. A sleeve receives a contact member and has a second snap-fit connection feature configured to releasably mate with the first snap-fit connection feature.

18 Claims, 19 Drawing Sheets

(56) References Cited

U.S. PATENT DOCUMENTS

| | | | | |
|---|---|---|---|---|
| 4,163,598 | A | 8/1979 | Bianchi | |
| 4,836,804 | A | 6/1989 | London | |
| 5,109,452 | A * | 4/1992 | Selvin | G02B 6/3878 385/60 |
| 5,242,315 | A | 9/1993 | O'Dea | |
| 5,679,016 | A | 10/1997 | Marder | |
| 5,718,600 | A | 2/1998 | D'Amario, Jr. | |
| 5,934,945 | A | 8/1999 | Petersen | |
| 6,168,476 | B1 | 1/2001 | Yang | |
| 7,195,514 | B2 | 3/2007 | Wakefield | |
| 7,658,657 | B1 | 2/2010 | Scanzillo | |
| 7,753,076 | B2 | 7/2010 | Mita | |
| 9,033,745 | B2 | 5/2015 | Kesiakov | |
| 2004/0077224 | A1 | 4/2004 | Marchese | |
| 2004/0171314 | A1 | 9/2004 | Lappohn | |
| 2010/0255729 | A1 * | 10/2010 | Su | H01R 35/02 439/660 |
| 2013/0337684 | A1 | 12/2013 | Luther | |
| 2018/0261944 | A1 * | 9/2018 | Papageorge | H01R 24/30 |
| 2020/0405371 | A1 * | 12/2020 | Prior | A61B 18/1442 |

OTHER PUBLICATIONS

Plasa Standards, ANSI E1.24-2012 Entertainment Technology Dimensional Requirements for Stage Pin Connectors, Jan. 10, 2012 (26 pages).

* cited by examiner

ELECTRICAL CONNECTOR AND SLEEVE FOR ELECTRICAL CONTACT

RELATED APPLICATION(S)

This application is a continuation of U.S. application Ser. No. 16/734,696, file Jan. 6, 2020, which is a continuation of U.S. application Ser. No. 15/919,931, file Mar. 13, 2018, which is based on U.S. Provisional Application Ser. No. 62/470,5416, filed Mar. 13, 2017, the disclosure of which are incorporated herein by reference in their entirety and to which priority is claimed.

FIELD

Various exemplary embodiments relate to an indoor electrical connector, for example a male stage pin connector. Various exemplary embodiments also relate to sleeve for holding a contact element in a connector housing.

BACKGROUND

Electrical connectors used for indoor applications typically include a male connector having one or more contacts extending from a housing and a female receptacle having openings configured to receive the male contacts. One example of such a connector is a stage pin connector that is typically used for providing dimmable power to stage lighting and other equipment.

SUMMARY

According to an exemplary embodiment, a stage pin electrical connector includes a housing having a first housing member and a second housing member. The first and second housing members are releasably connected together to define an interior, a conductor opening, a contact portion, and a contact opening. The contact portion includes a first snap-fit connection feature. A sleeve receives a contact member and has a second snap-fit connection feature configured to releasably mate with the first snap-fit connection feature.

According to another exemplary embodiment, a stage pin electrical connector includes a first housing having a first conductor opening, a first contact portion, and a latch member. A second housing member has a second conductor opening, a second contact portion, and a pocket. The second housing member is releasably connectable to the first housing member and the pocket is configured to pivotally receive the latch member. A sleeve receives a contact member. The sleeve and the contact member are received in the first contact portion and the second contact portion.

Another exemplary embodiment includes A method of assembling a stage pin electrical connector. A contact member is selected and inserted into a sleeve. A conductor is connected to the contact member. The assembled sleeve and contact member are connected to a first housing member. A second housing member is connected to the first housing member.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
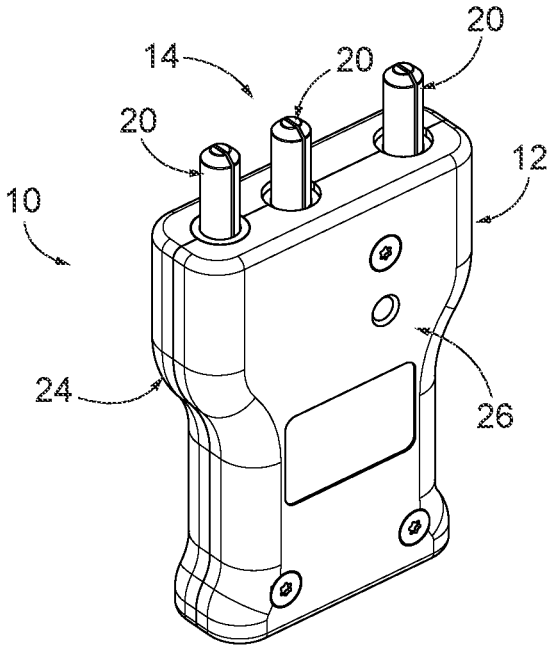
FIG. 1 is a perspective view of an exemplary stage pin connector with male contacts.
Figure 2:
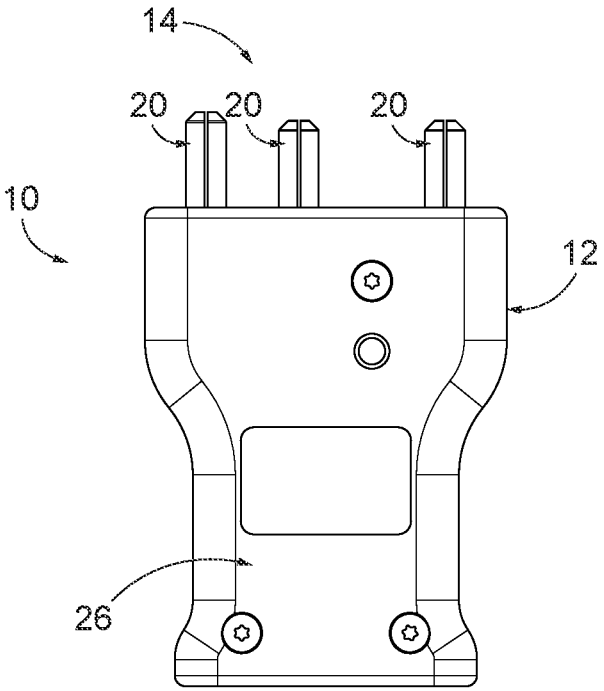
FIG. 2 is a top view of FIG. 1.
Figure 3:
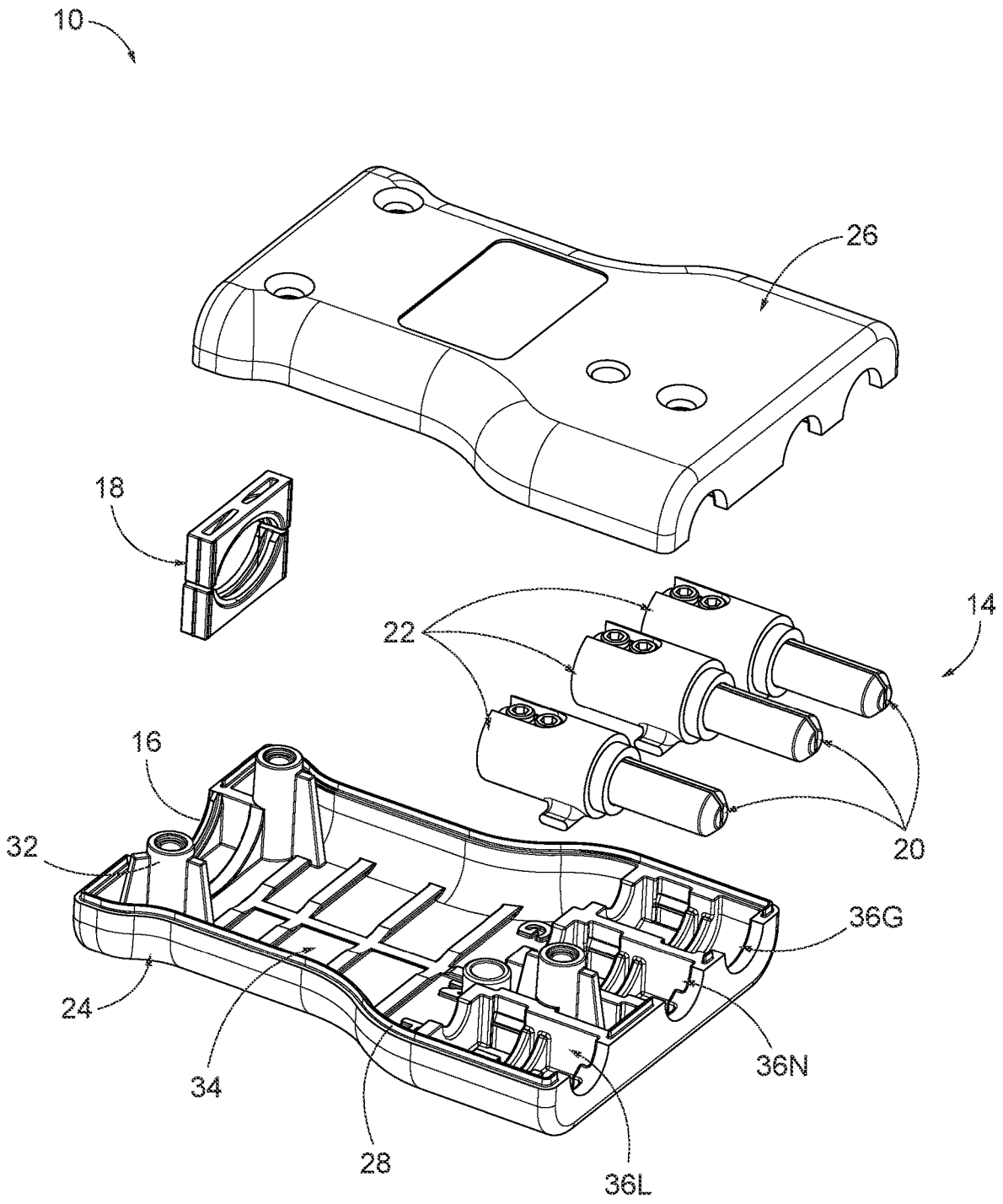
FIG. 3 is an exploded view of FIG. 1.

FIGS. 1-3 show an exemplary embodiment of a male stage pin connector 10 having a housing 12 and a set of contacts 14 extending from a first end of the housing 12. A conductor opening 16 is positioned in the second end of the housing 12 to receive a conductor such as an insulated cable (not shown). The insulated cable can include three separate strand conductors that may also be insulated (not shown). The cable can be stripped and the ground, neutral, and line strands separated to be connected to the respective contacts 14 inside the housing. One or more strain relief members 18 can be positioned in the conductor opening 16 of the housing 12. The housing 12 is constructed for impact resistance and high temperature resistance, allowing it to undergo repeated use and rough handling.

The contacts include three male pin contacts 20, with a ground pin, a neutral pin, and a line pin. The pins 20 have an asymmetrical configuration, with the neutral pin positioned closer to the ground pin than to the line pin, ensuring that a proper connection is made by a user. The ground pin also extends further from the housing 12 than the neutral and line pins, ensuring a ground connection is made prior to the neutral and line connections when inserting the plug into a female connector or socket. The male contact pins 20 are connected to insulating sleeves 22 that connect to the housing 12. According to an exemplary embodiment, the insulating sleeves 22 are snap-fit to the housing 12, with at least a first snap-fit feature on the housing 12 and a second mating, snap-fit feature on the insulating sleeve 22.

Figure 4:
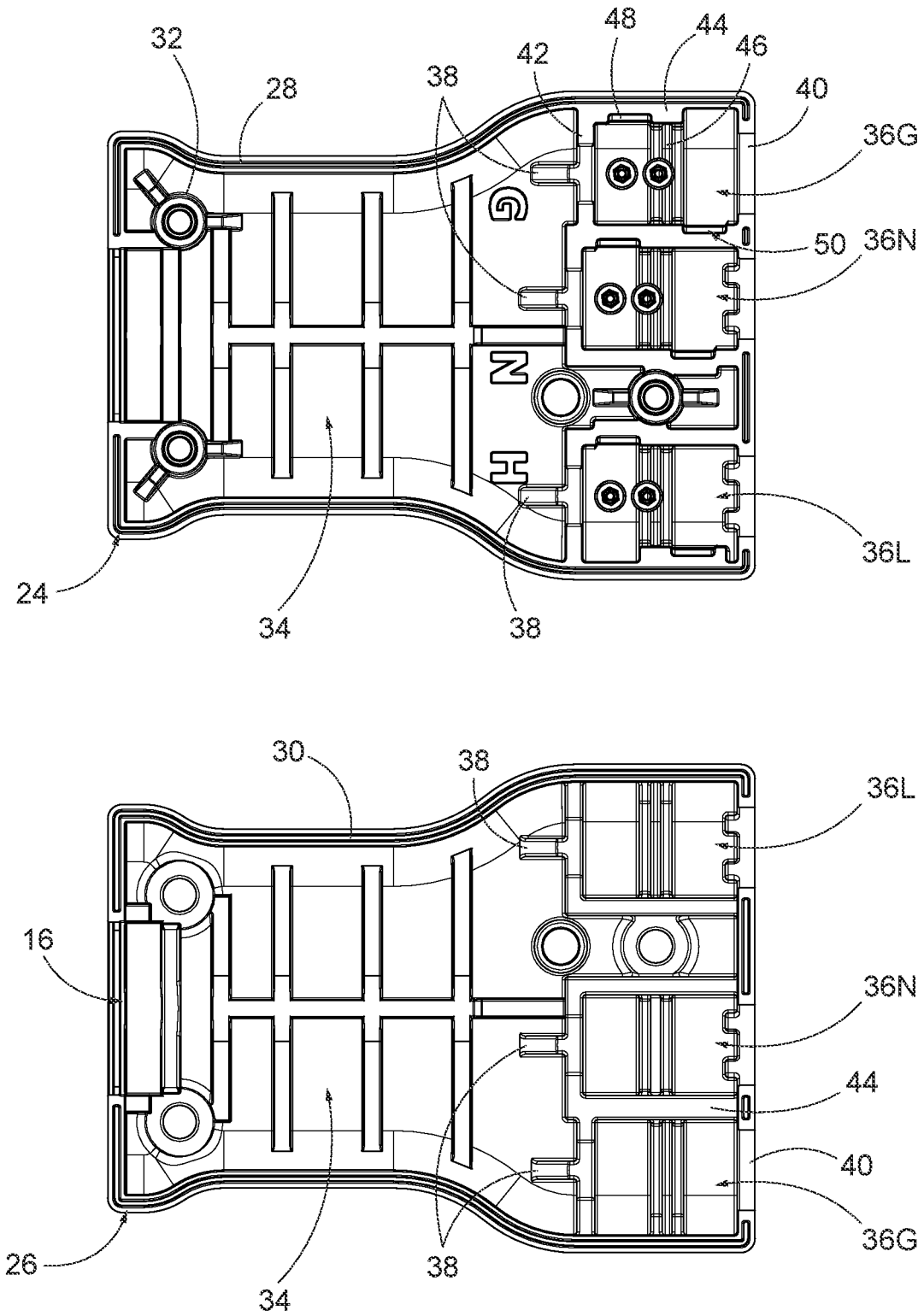
FIG. 4 is a top view of the exemplary separated first housing member and second housing member of FIG. 1.

FIG. 4 shows the housing 12 having a first housing member 24 and a second housing member 26 that are releasably connected to one another and define an interior. The housing members 24, 26 can include an alignment feature that helps with assembly. For example, the first housing member 24 includes one or more male projections 28 located at an outer region and the second housing member 26 includes one or more female depressions 30 located at an outer region at corresponding positions to the projections 28. In an exemplary embodiment, the male projections 28 extend from an outer edge of the first housing member 24 and the female depressions 30 extend into an outer edge of the second housing member 26. The first and second housing members 24, 26 also include aligned bosses 32 that can receive a fastener. The fastener can be a threaded screw to releasably secure the first and second housing members 24, 26, although other fasteners, including non-releasable fasteners can be used.

The first and second housing members 24, 26 each include a conductor portion 34 adjacent the conductor opening 16 and a set of contact portions, for example a ground contact portion 36G, a neutral contact portion 36N, and a line contact portion 36L. A ramp 38 extends from the conductor portion 34 to the each of the contact portions to help guide and retain the conductor strands to the male contact pins 20. The contact portions include a top wall 40 having an opening through which the male contact pins 20 extend and a bottom wall 42 having an opening for receiving the conductor strands. Side walls 44 extend between the top wall 40 and bottom wall 42. The ground contact portion 36G is offset from the neutral and line contact portions 36N, 36L by having the bottom and top walls 42, 40 shifted in the forward direction. Each of the contact portions is separated into a forward and rear portion by one or more ribs 46 that help center the insulating sleeves 22 in the contact portions.

According to an exemplary embodiment, each of the contact portions includes at least one snap-fit connection feature. For example a snap-fit feature is provided in each of the side walls 44, with a first connection feature positioned in the rear portion and a second connection feature positioned in the forward portion. In an exemplary embodiment, the first connection feature includes a first protrusion 48 and the second connection feature includes a second protrusion 50. The first and second connection features can have a wedge shape with an outer-facing, angled side wall and a lower wall. The protrusions 48, 50 can be rigid or allow for some deflection, but be configured to receive and retain the insulating sleeve 22.

Figure 5:
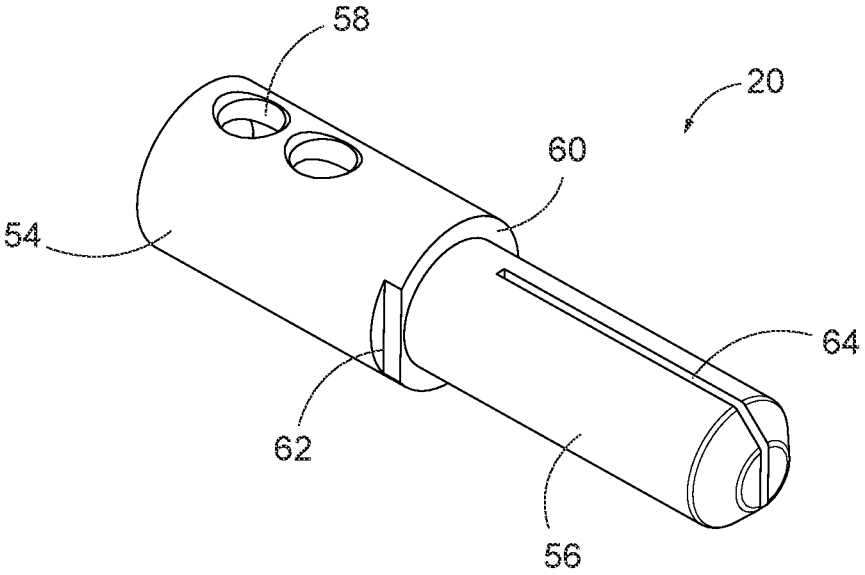
FIG. 5 is a perspective view of the exemplary male contact pin of FIG. 1.

FIG. 5 shows an exemplary embodiment of a male contact pin 20 having a base 54 and a shaft 56 extending from the base 54. The base 54 has one or more threaded openings 58 for receiving a set screw. The set screw is used to retain the individual strand conductors in the male contact pin 20. The base 54 includes an exterior ledge 60 facing the forward direction. A pin shoulder 62 is formed in the exterior ledge 60. A slit 64 can be formed in the shaft 56, dividing the shaft 56 into halves. The slit 64 can allow the shaft 56 to be compressed when it enters a female receptacle, creating a friction engagement between the male contact pin and the female contact sleeve.

Figure 6:
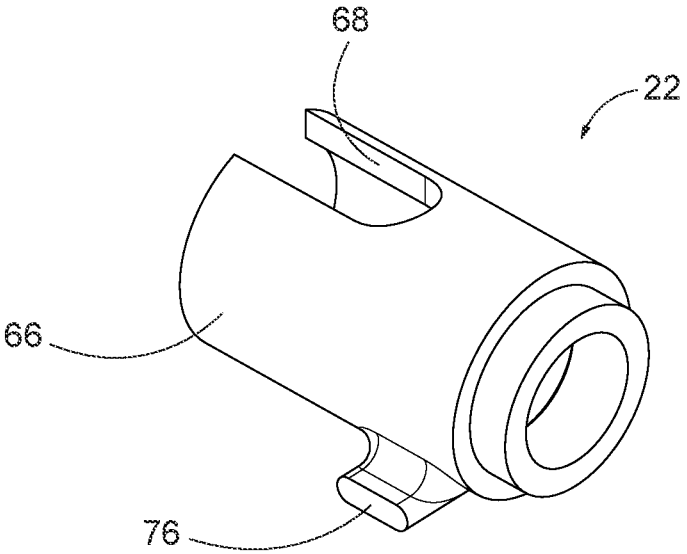
FIG. 6 is a perspective view of the exemplary insulating sleeve of FIG. 1.
Figure 7:
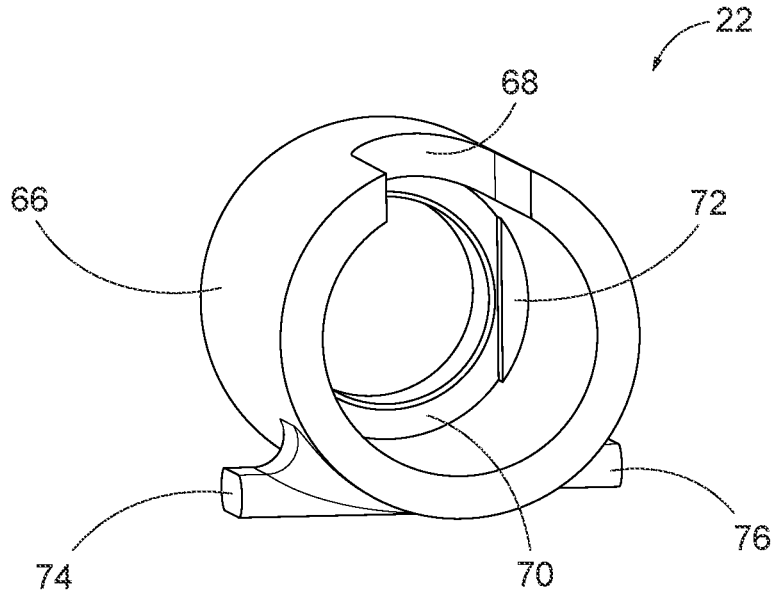
FIG. 7 is another perspective view of the insulating sleeve of FIG. 6.
Figure 8:
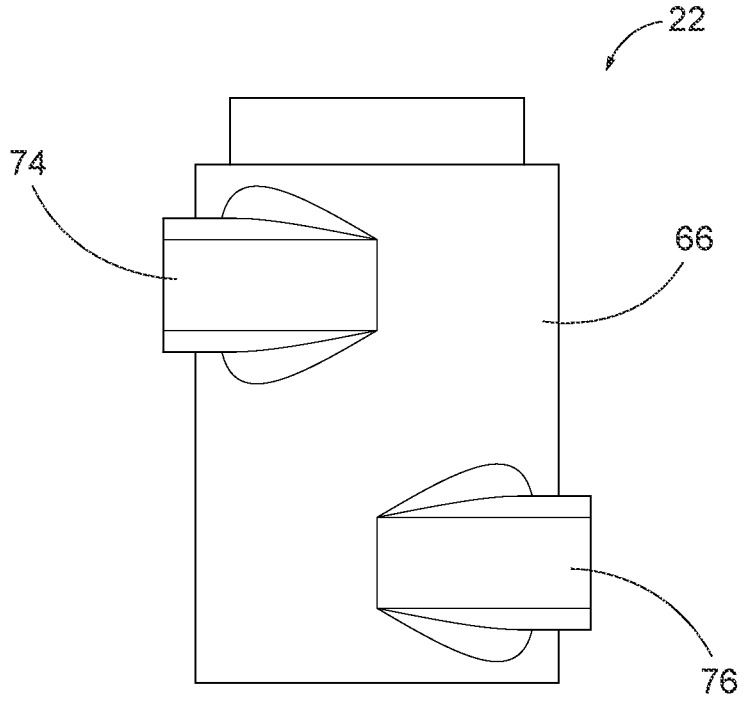
FIG. 8 is a top view of the insulating sleeve of FIG. 6.
Figure 9:
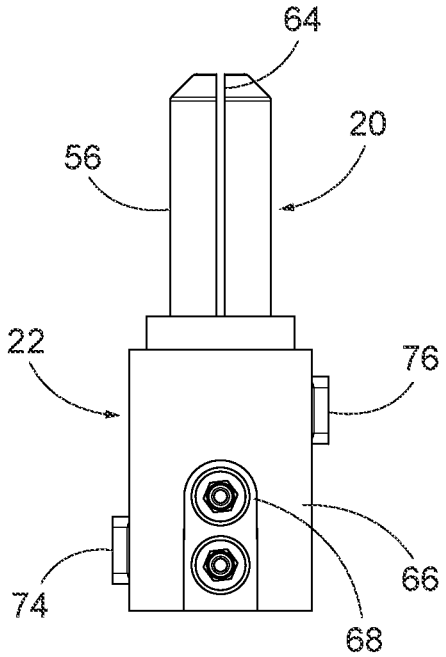
FIG. 9 is a top view of the connected insulating sleeve and male contact pin.

FIGS. 6-8 show an exemplary embodiment of the insulating sleeve 22 and FIG. 8 shows the insulating sleeve 22 connected to the male contact pin 20. The insulating sleeve 22 includes a body 66 having a central opening for receiving the male contact pin 20 or female contact sleeve. An arched opening 68 aligns with the set screws in the base 54 of the pin 20. A rearward facing inner ledge 70 is formed in the interior of the body 66. An insulating sleeve shoulder 72 is formed in the inner ledge 70 that corresponds with either the female contact pin shoulder or male contact pin shoulder 62 to help properly align the female contact sleeve or male contact pin 20 with the insulating sleeve 22 during assembly. In an exemplary embodiment, the insulating sleeve shoulder 62 is a male shoulder that mates with a female shoulder 72, although other alignment mechanisms and configurations can be used.

As discussed above, the insulating sleeve 22 includes at least one snap-fit connection feature. In an exemplary embodiment the snap-fit connection feature includes a first lug 74 and a second lug 76. The first and second lugs 74, 76 extend outwardly from the body 66 in opposite directions, with the second lug 76 positioned forward of the first lug 74. The lugs 74, 76 can be cantilevered beams that at least partially deflect as they are connected to the snap-fit features of the housing 12. Some embodiments, however, can also use rigid beams.

In various exemplary embodiments, the insulating sleeves 22 and the first and second housing members 24, 26 are made from a non-conductive material, high-temperature resistant material, such as a high-temperature resistant polymer or thermoplastic. In certain embodiments, the insulating sleeves 22 and the first and second housing members 24, 26 are made from a molded thermoset plastic material, which provides advantages over other materials, including machined phenolic plastic. These advantages include superior thermal insulation and durability while also increasing manufacturing efficiency.

Figure 10:
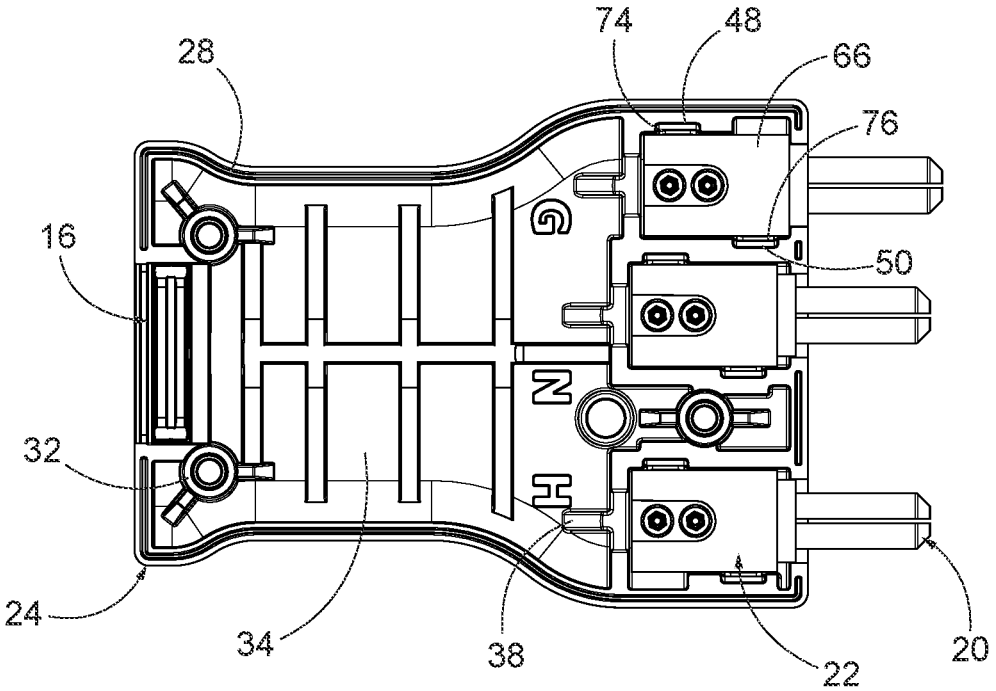
FIG. 10 is a top view of the first housing member with three insulating sleeves and male contact pins connected thereto.
Figure 11:
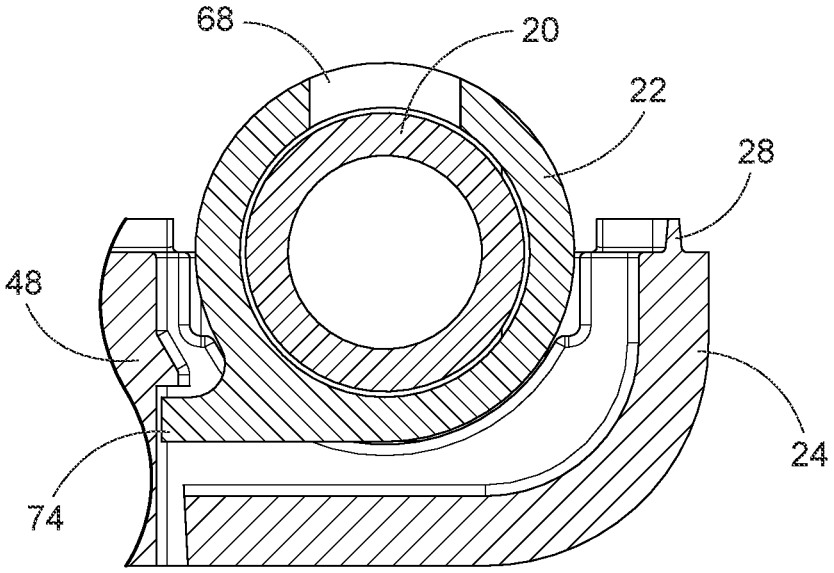
FIG. 11 is a partial, sectional view of the male contact pin and insulating sleeve connected to the first housing member of FIG. 1.
Figure 12:
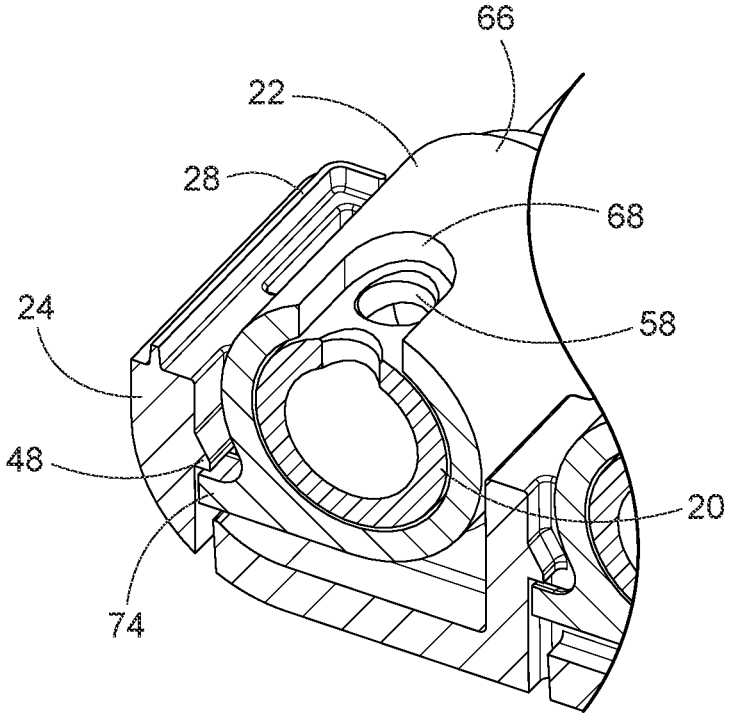
FIG. 12 is a perspective view of FIG. 11.

FIGS. 10-12 show the male contact pins 20 and insulating sleeves 22 connected to the housing 12. The male contact pins 20 can be initially inserted into the insulating sleeves 22, with the male contact pin shoulder 62 and the insulating sleeve shoulder 72 mated to ensure proper alignment. The insulating sleeves 22 are then snap-fit to the first housing member 24. This can be achieved by press-fitting both of the snap-fit connections on the insulating sleeve into the snap fit connections on the first housing member 24, or by angling one of the lugs 74, 76 underneath the respective protrusion, and press-fitting the other lug into the other protrusion.

Figure 13:
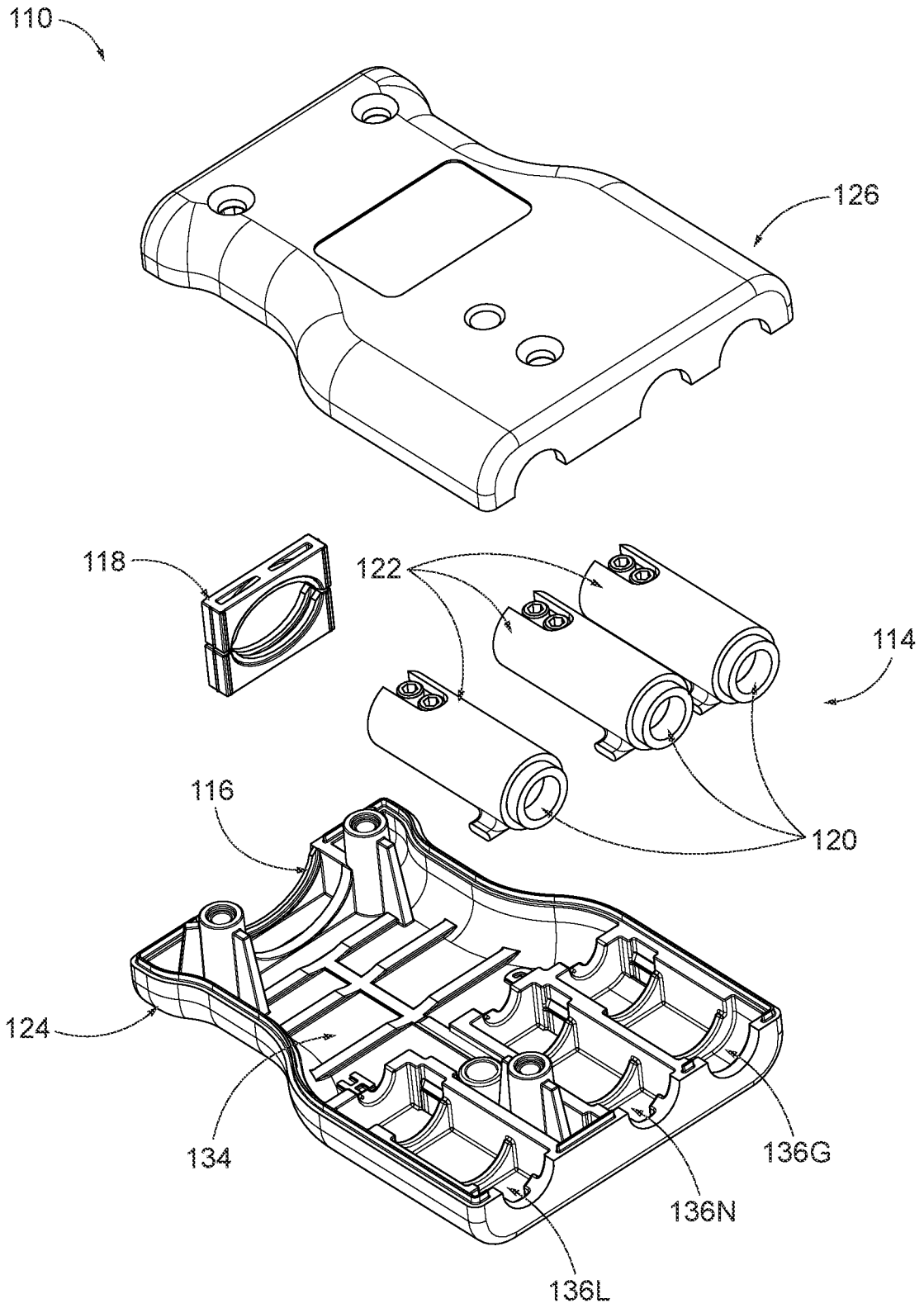
FIG. 13 is a perspective, exploded view of an exemplary stage pin connector with female contacts.

FIG. 13 shows an exemplary embodiment of a female stage pin connector 110 having a housing 112 and a set of female contacts 114 positioned at a first end of the housing 112 and a conductor opening 116 positioned in the second end of the housing 112 to receive a conductor such as an insulated cable (not shown). The insulated cable can include three separate strand conductors that may also be insulated (not shown). The cable can be stripped and the ground, neutral, and line strands separated to be connected to the respective contacts 114 inside the housing. One or more strain relief members 118 can be positioned in the conductor opening 116 of the housing 112. The housing 112 is constructed for impact resistance and high temperature resistance, allowing it to undergo repeated use and rough handling.

The female contacts include three female sleeve contacts 120, with a ground sleeve, a neutral sleeve, and a line sleeve. The housing 112 includes a first housing member 124 and a second housing member 126. The first and second housing members 124, 126 each include a conductor portion 34 adjacent the conductor opening 116 and a set of female contact portions, for example a female ground contact portion 136G, a female neutral contact portion 136N, and a female line contact portion 136L.

Figure 14:
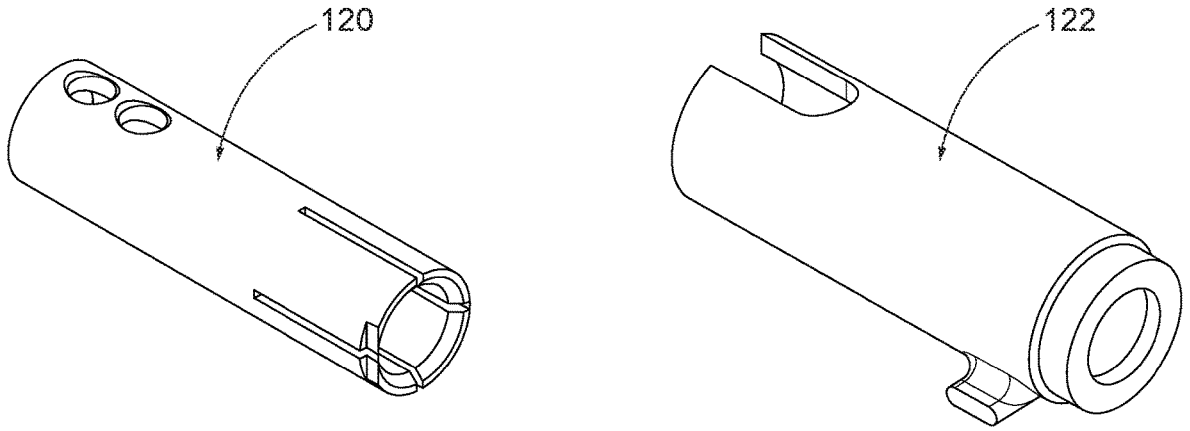
FIG. 14 is a perspective view of a female contact and the insulating sleeve.

FIG. 14 shows an exemplary embodiment of a female contact 120 and an insulating sleeve 122. The insulating sleeve 122 can be identical or substantially similar to the one described above with respect to the male pin insulating sleeve 22. The female contact 120 can be configured to mate with the insulating sleeve and snap-fit to the housing member 124.

Various exemplary embodiments are directed to a method of assembling an electrical connector having the features described above. During assembly, a multi-strand conductor can be stripped and separated into ground, neutral, and line conductors. If these conductors are also insulated, a portion of the remaining insulation may be stripped from the ends of the conductors. Female contact sleeves and male contact pins 20 are inserted into the insulating sleeves 22, with the male and female contact pin shoulder 62 and the insulating sleeve shoulder 72 mated to ensure alignment. In one embodiment, the conductors are inserted into either the female contact sleeve or male contact pin 20 and insulating sleeve 20 combination, and secured by one or more set screws. The female contact sleeve or male contact pins 20 are then snap-fit to the first housing member 24. The conductors are positioned to extend through the conductor receiving portion 34 and out of the conductor opening 16. The unstripped portion may be adjacent the outside of the conductor opening 16 or positioned inside the conductor receiving portion 34. The second housing member 26 is then connected to the first housing member 24, using the alignment features, for example the male projections 28 and female depressions 30. One or more fasteners are then used to secure the first housing member 24 to the second housing member 26. In another embodiment, the female contact sleeve or male contact pins 20 and insulating sleeves 22 are snap-fit to the first housing member 24 prior to the conductors being inserted into the female contact sleeve or male contact pins 20.

Figure 15:
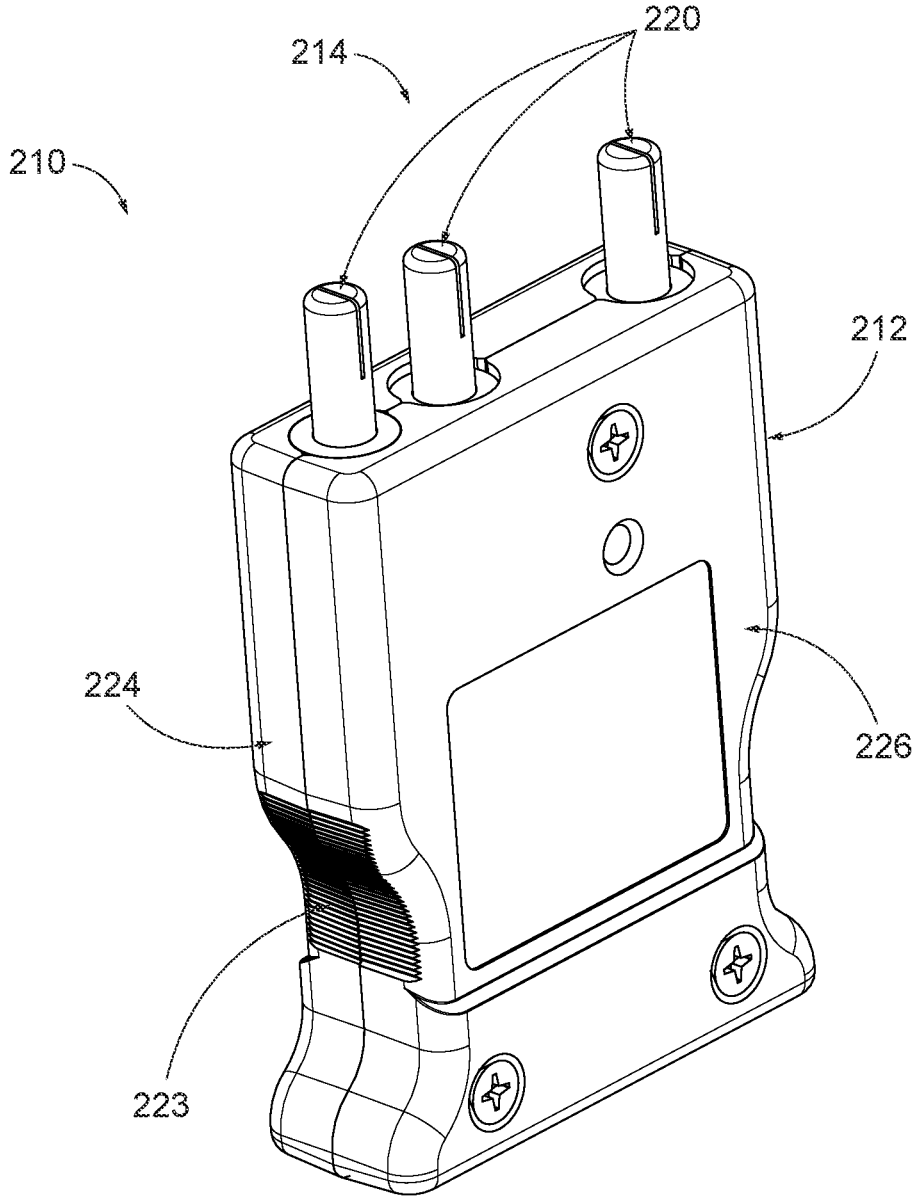
FIG. 15 is a perspective view of another exemplary stage pin connector.
Figure 19:
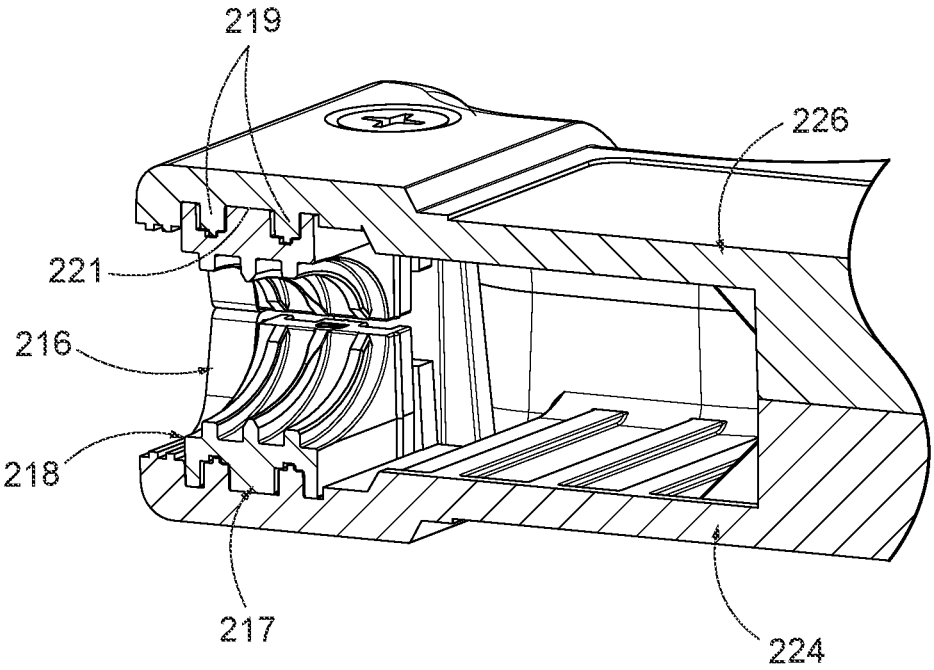
FIG. 19 is partial, sectional view of the stage pin connector of FIG. 15 showing the connection of the strain relief member.

FIG. 15 show another exemplary embodiment of a male stage pin connector 210 having a housing 212 and a set of contacts 214 extending from a first end of the housing 212. A conductor opening 216 is positioned in the second end of the housing 212 to receive a conductor such as an insulated cable (not shown). The insulated cable can include three separate strand conductors that may also be insulated (not shown). The cable can be stripped and the ground, neutral, and line strands separated to be connected to the respective contacts 214 inside the housing. As best shown in FIG. 19, the housing 212 includes a strain relief retainer 217 near the conductor opening 216. The strain relief retainer 217 is configured to receive and retain one or more strain relief members 218. As shown in the illustrated example, the strain relief retainer 217 includes a set of projections 219 bounding a channel 221 and the strain relief member 218 includes mating structure to form an interference fit or friction engagement.

The housing 212 is constructed for impact resistance and high temperature resistance, allowing it to undergo repeated use and rough handling. The housing 212 also includes a grip portion 223 positioned on both sides. The grip portion 223 can include ribs, knurls, or other surface features to increase friction between a user and the housing 212.

The contacts include three male pin contacts 220, with a ground pin, a neutral pin, and a line pin. The pins 220 have an asymmetrical configuration, with the neutral pin positioned closer to the ground pin than to the line pin, ensuring that a proper connection is made by a user. The ground pin also extends further from the housing 212 than the neutral and line pins, ensuring a ground connection is made prior to the neutral and line connections when inserting the plug into a female connector or socket. The male contact pins 220 are connected to insulating sleeves 222 that connect to the housing 212. According to an exemplary embodiment, the insulating sleeves 222 are snap-fit to the housing 212, with at least a first snap-fit feature on the housing 212 and a second mating, snap-fit feature on the insulating sleeve 222.

Figure 17:
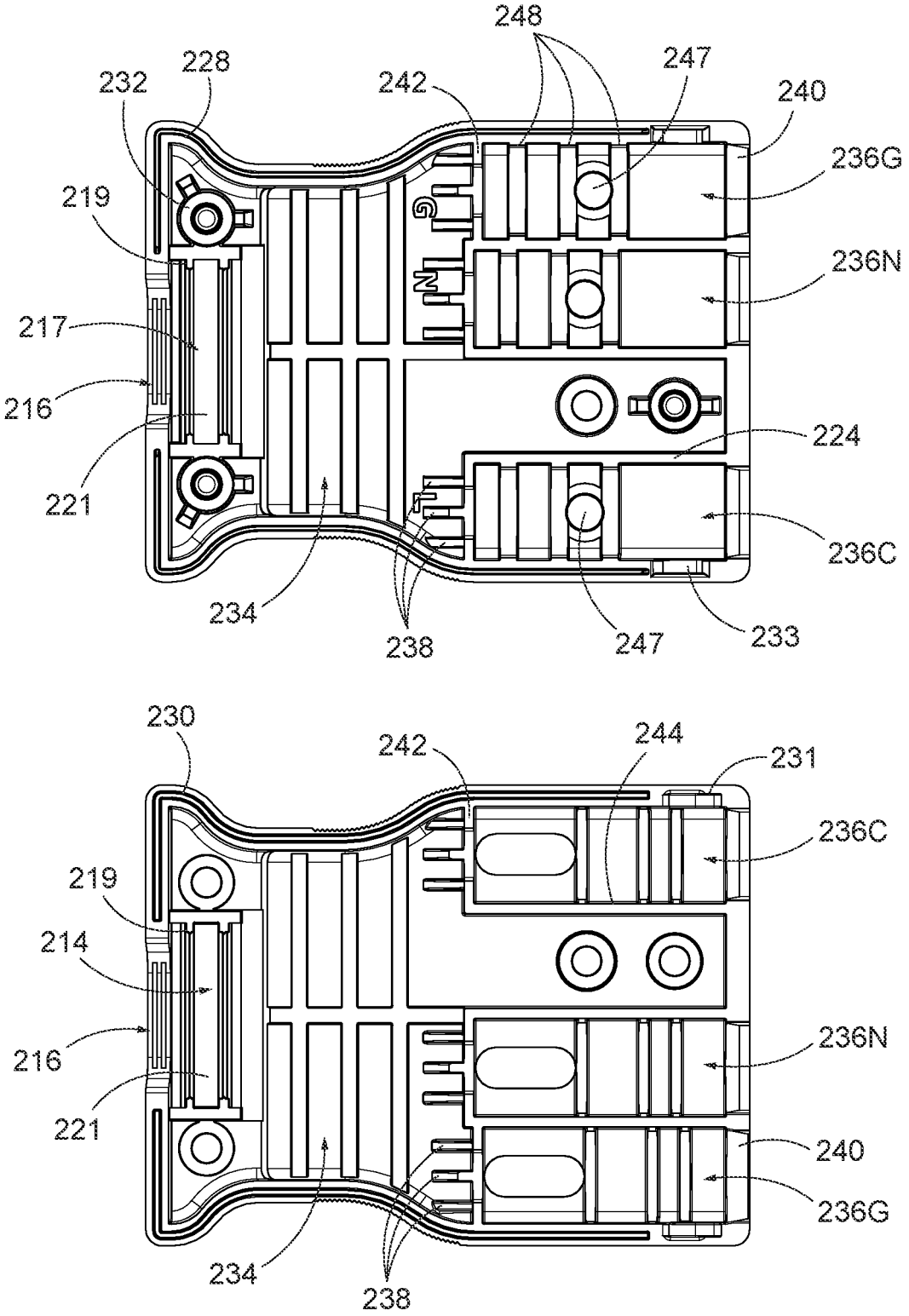
FIG. 17 is a top view of the exemplary separated first housing member and second housing member of FIG. 15.

FIG. 17 shows a first housing member 224 and a second housing member 226 that are releasably connected to one another and define an interior. The housing members 224, 226 can include an alignment feature that helps with assembly. For example, the first housing member 224 includes one or more male projections 228 located at an outer region and the second housing member 226 includes one or more female depressions 230 located at an outer region at corresponding positions to the projections 228. In an exemplary embodiment, the male projections 228 extend from an outer edge of the first housing member 224 and the female depressions 230 extend into an outer edge of the second housing member 226. The first and second housing members 224, 226 also include aligned bosses 232 that can receive a fastener. The fastener can be a threaded screw to releasably secure the first and second housing members 224, 226, although other fasteners, including non-releasable fasteners can be used.

Figure 16:
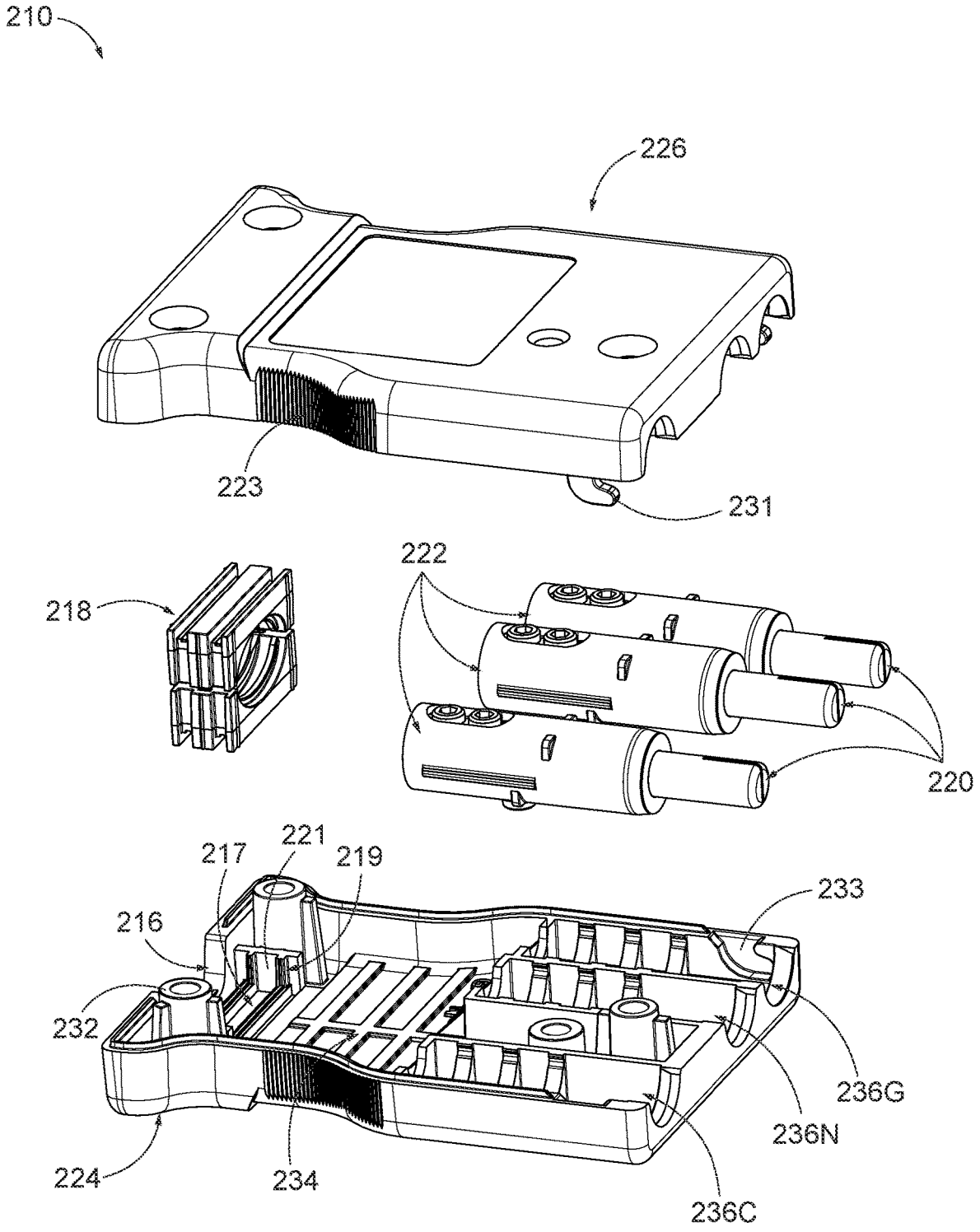
FIG. 16 is a exploded view of FIG. 15.
Figure 18:
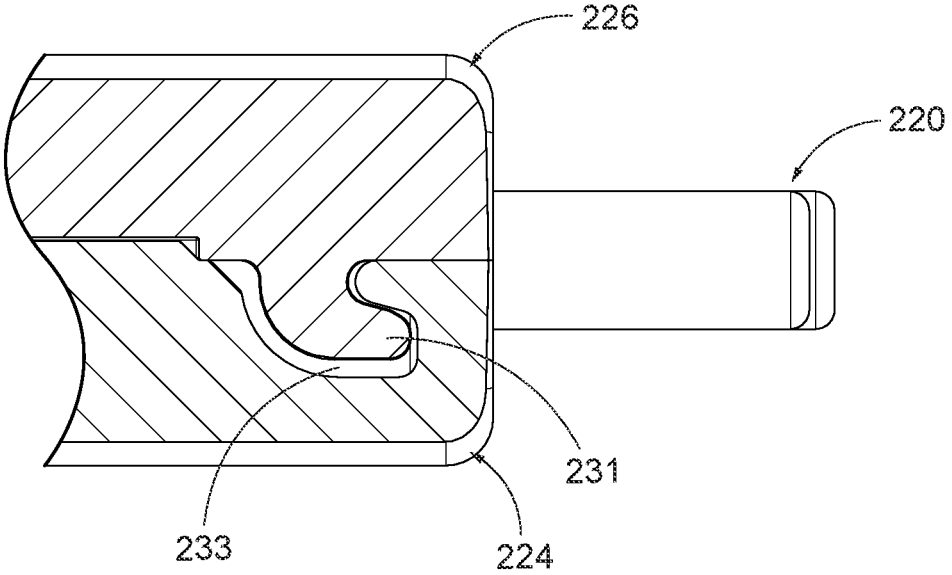
FIG. 18 is a partial, sectional view of the stage pin connector of FIG. 15 showing the hinge connection between the first and second housing members.

The first and second housing members 224, 226 can also include a hinge connection as best shown in FIGS. 16 and 18. The second housing member 226 includes a latch member 231 and the first housing member 224 includes a pocket 233 configured to receive the latch member 231. The latch member 231 and the pocket 233 have curved, substantially hook-shaped configurations, so that the latch member 231 is angled into the pocket 233. This creates a pivoting connection between the first and second housing members 224, 226 and helps to retain the first and second housing member 224, 226 without the use of screws or other removable fasteners. As best shown in FIGS. 16 and 17, the latch member 231 and pocket 233 are positioned near the outer perimeter of the respective housing members 224, 226, but are not exposed to the exterior. This allows a secure connection that helps prevent or reduce any separation of the housing members 224, 226 while providing a smoother, clean exterior appearance.

As best shown in FIG. 16, the first and second housing members 224, 226 each include a conductor portion 234 and a set of contact portions, for example a ground contact portion 236G, a neutral contact portion 236N, and a line contact portion 236L. Ramps 238 extends from the conductor portion 234 to the each of the contact portions to help guide and retain the conductor strands to the male contact pins 220. The contact portions include a top wall 240 having an opening through which the male contact pins 220 extend and a bottom wall 242 having an opening for receiving the conductor strands. Side walls 244 extend between the top wall 240 and bottom wall 242. The ground contact portion 236G is offset from the neutral and line contact portions 236N, 236L by having the bottom and top walls 242, 240 shifted in the forward direction. Each of the contact portions is separated into a forward and rear portion by one or more ribs 246 that help center the insulating sleeves 222 in the contact portions. The contact portions also include cylindrical depressions 247 to help align the insulating sleeves 222.

According to an exemplary embodiment, each of the contact portions includes at least one snap-fit connection feature. For example a snap-fit feature is provided in each of the side walls 244. In an exemplary embodiment, the connection features include a set of protrusions 248 extending from the side walls 244 into the contact portions. The protrusions 248 can be rigid or allow for some deflection, and are configured to receive and retain the insulating sleeve 222.

Figure 20:
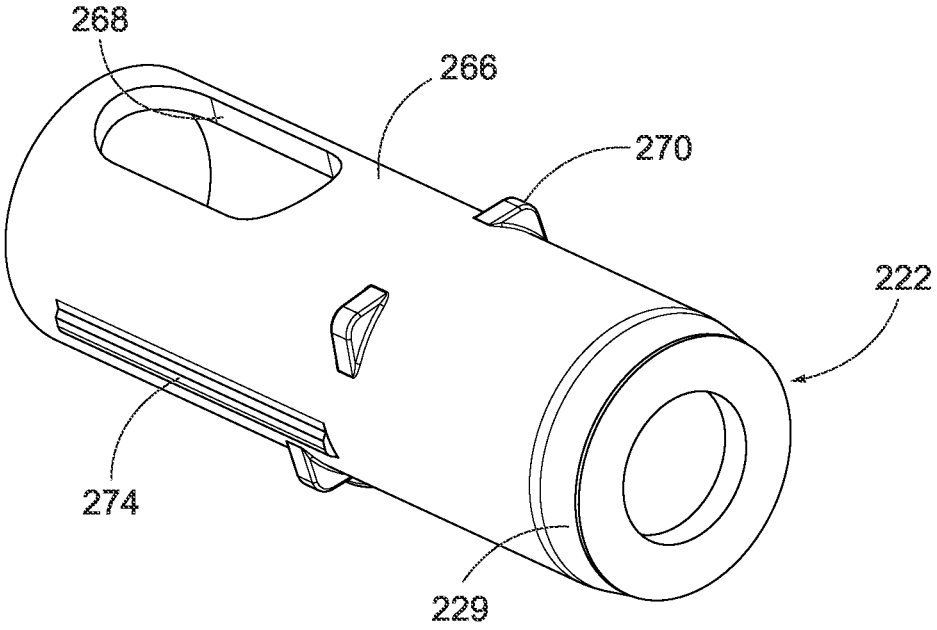
FIG. 20 is a perspective view of the insulating sleeve of FIG. 15.
Figure 21:
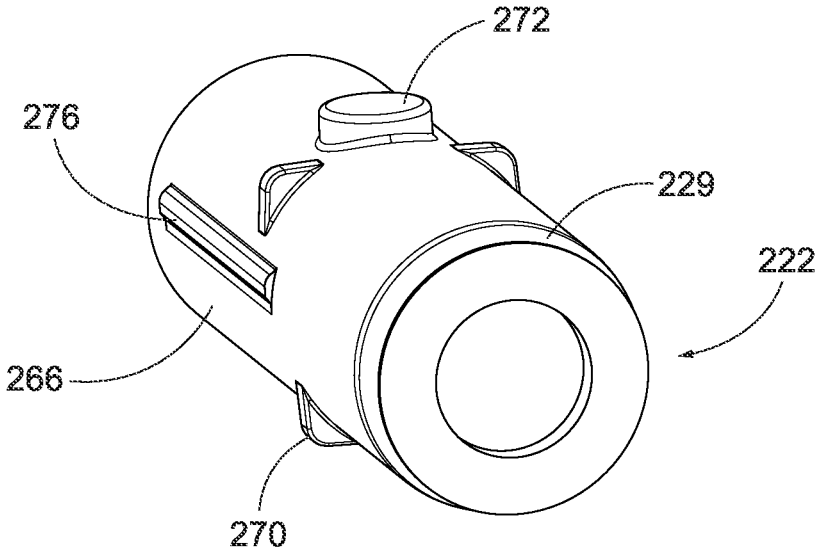
FIG. 21 is another perspective view of the insulating sleeve of FIG. 15 with the sleeve rotated approximately 180 degrees from FIG. 20.

FIGS. 20 and 21 show an exemplary embodiment of the insulating sleeve 222. The insulating sleeve 222 includes a body 266 having a central opening for receiving the male contact pin 220 or female contact sleeve. An arched opening 268 aligns with the set screws in the pin 220. When a contact is connected to the insulating sleeve 222, the sets screws can extend at least partially through the opening 268, so that the set screws prevent the contact from rotating relative to the insulating sleeve 222. The nose 229 of the insulting sleeve 222 includes a portion having a smaller diameter than the remainder of the body so that it can be engaged with the housing members 224, 226. The nose 229 can have a tapered configuration (e.g., frusto-conical) so that it can be wedged into a corresponding taper in the contact opening region of the housing members 224, 226, as shown in FIG. 17, forming a friction or interference fit that helps to retain the insulating sleeve 222. The nose 229 can also have a stepped configuration that forms a ledge that can be mated with a corresponding ledge in the housing members 224, 226.

The insulating sleeve 222 includes one or more projections to align and retain the insulating sleeve 222 in the contact portion of the housing 212. In an exemplary embodiment, a set of four substantially triangular projections 270 are arrayed around the body 266 and a substantially cylindrical projection 272 extends from the body 266 substantially opposite from the arched opening 268. The cylindrical projection 272 mates with the cylindrical depression 247 in the contact portion of the second housing member 226.

As discussed above, the insulating sleeve 222 includes at least one snap-fit connection feature. In an exemplary embodiment the snap-fit connection feature includes a first rib 274 and a second rib 276. The first and second ribs 274, 276 extend outwardly from the body 266 in opposite directions. The ribs 274, 276 can be cantilevered beams that at least partially deflect as they are connected to the snap-fit features of the housing 212. Some embodiments, however, can also use rigid beams.

Figure 22:
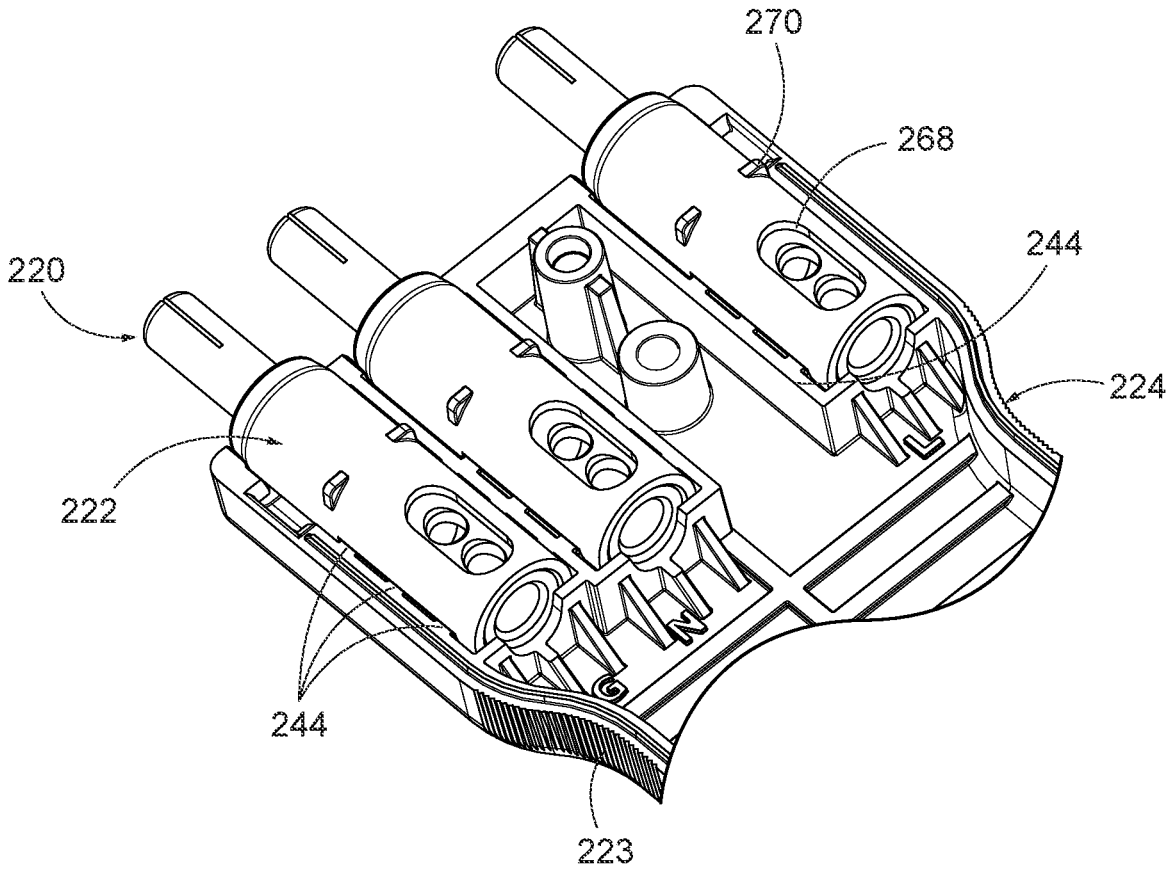
FIG. 22 is a partial, sectional view of the male contact pins and insulating sleeves connected to the first housing member of FIG. 15.
Figure 23:
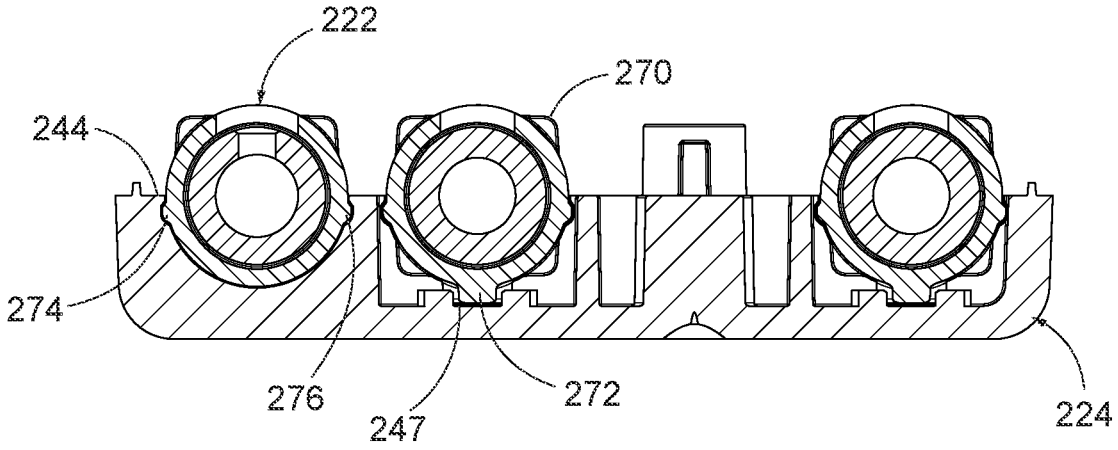
FIG. 23 is partial rear, sectional view of the male contact pins and insulating sleeves connected to the first housing member of FIG. 15.

FIGS. 22 and 23 shows the male contact pins 220 and insulating sleeves 222 connected to the first housing member 224. The male contact pins 220 are initially inserted into the insulating sleeves 222 and then snap-fit to the first housing member 224. This can be achieved by press-fitting both of the snap-fit connections on the insulating sleeve into the snap fit connections on the first housing member 224, with the cylindrical projection 272 aligned with the depression 247. FIG. 23 shows a sectional view of the snap-fit connection, with the first and second ribs 274, 276 positioned in grooves in the housing at least partially defined by the snap-fit protrusions 248.

Figure 24:
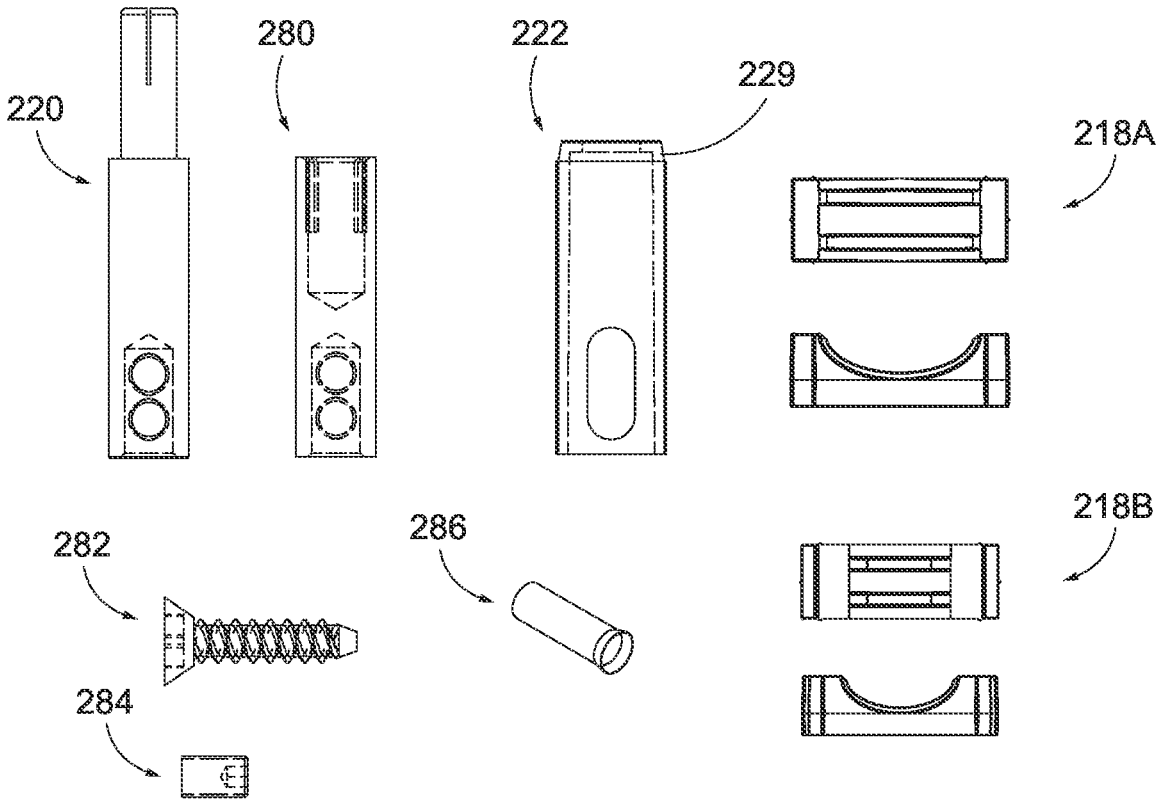
FIG. 24 is a view of exemplary connector components.

FIG. 24 shows exemplary components that can be used with the connectors. The components can include one or more sets of housing members 12, 212 (as shown in FIG. 1-14 or 15-23), a set of male contacts 220, a set of female contacts 28*o*, a set of insulating sleeves 222, one or more sets of strain relief members 218A, 218B, a set of mounting screws 282 and set screws 284, and a set of wire ferrules 286. The size, shape, and configurations of the components can be varied depending on the type of connection or associated conductor. For example, different configurations of housing members can be used for different amp ratings (e.g., 60 A, 100 A) or for different voltage ratings (e.g., 125V, 250V). The sizes and configurations of the components shown in FIG. 24 can be altered accordingly.

Figure 25:
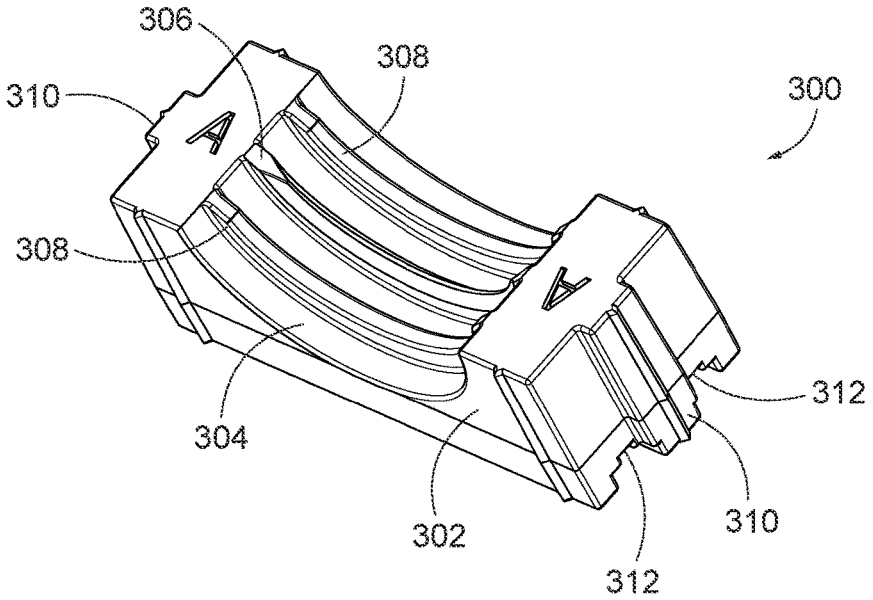
FIG. 25 is a perspective view of a first strain relief member.
Figure 26:
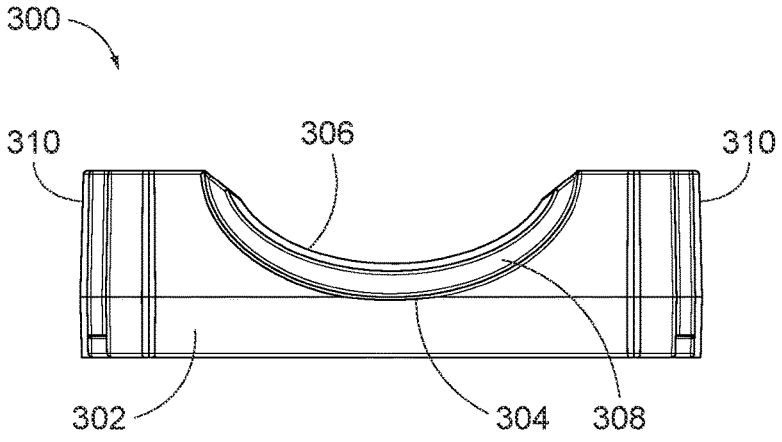
FIG. 26 is a front view of FIG. 25.
Figure 27:
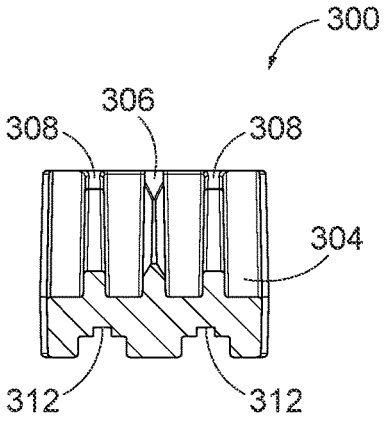
FIG. 27 is a side, sectional view of FIG. 25.

FIGS. 25-27 show an exemplary embodiment of a first strain relief member 300. The strain relief member 300 includes a body 302 having a concave depression 304 and a set of ribs extending into the depression. The ribs include a central rib 306 and a pair of outer ribs 308. The central rib 306 and outer ribs 308 are curved and each include a tapered section that narrows the ribs 306, 308. The central rib 306 has a more pronounced tapered portion and includes an upper edge that is raised above the outer ribs 308. Each of the ribs 306, 308 is flexible and compressible so that it can accommodate a range of conductor sizes. The body 302 includes a set of tabs 310 extending out to the sides. A set of furrows 312 are positioned in the base of the body 302. The tabs 310 are configured to engage with the channels 221 and the furrows 312 are configured to engage with the projections 219 of the strain relief portions 217 of the housing members 224, 226.

Figure 28:
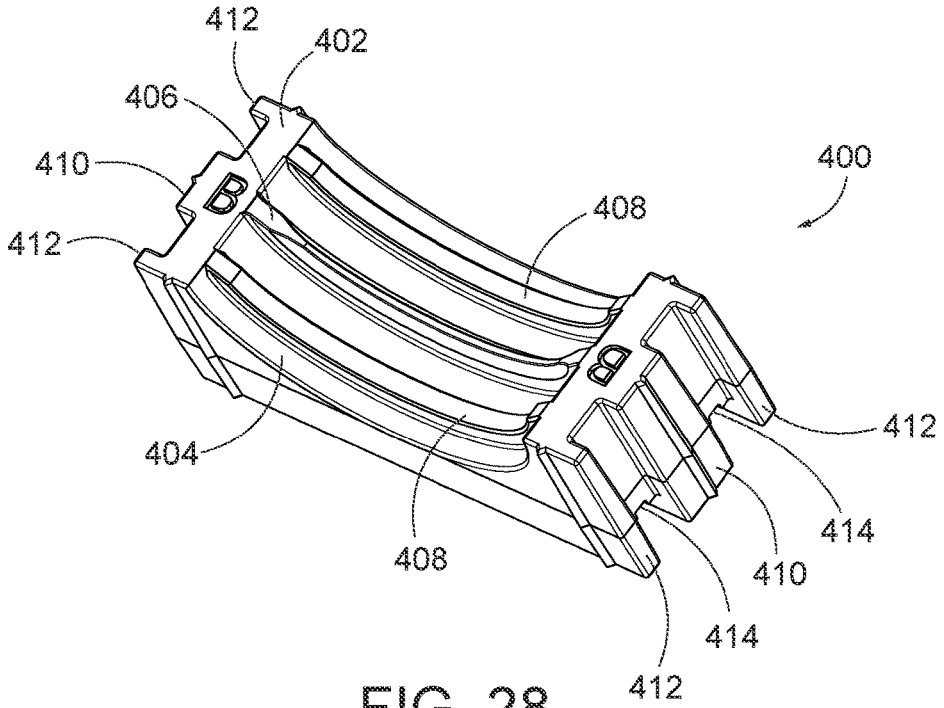
FIG. 28 is a perspective view of a second strain relief member.
Figure 29:
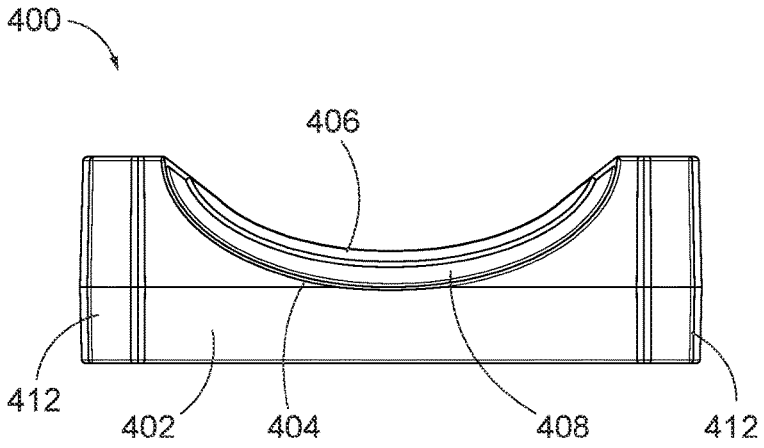
FIG. 29 is a front view of FIG. 28.
Figure 30:
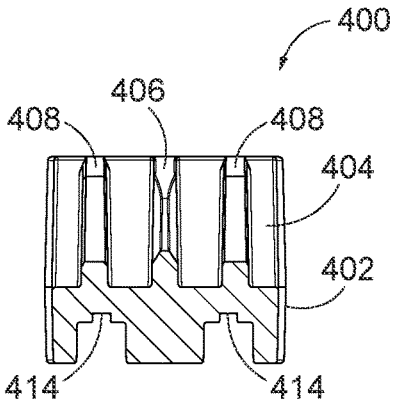
FIG. 30 is a side, sectional view of FIG. 28.

FIGS. 28-30 show an exemplary embodiment of a second strain relief member 400. The strain relief member 400 includes a body 402 having a concave depression 404 and a set of ribs extending into the depression. The ribs include a central rib 406 and a pair of outer ribs 408. The central rib 406 and outer ribs 408 are curved and each include a tapered section that narrows the ribs 306, 308. The central rib 306 has a more pronounced tapered portion and includes an upper edge that is raised above the outer ribs 308. Each of the ribs 306, 308 is flexible and compressible so that it can accommodate a range of conductor sizes. The body 302 includes a set of central tabs 410 and outer tabs 412 extending out to the sides. A set of furrows 414 are positioned in the base of the body 402. The tabs 410, 412 are configured to engage with the channels 221 and the furrows 414 are configured to engage with the projections 219 of the strain relief portions 217 of the housing members 224, 226.

Figure 31:
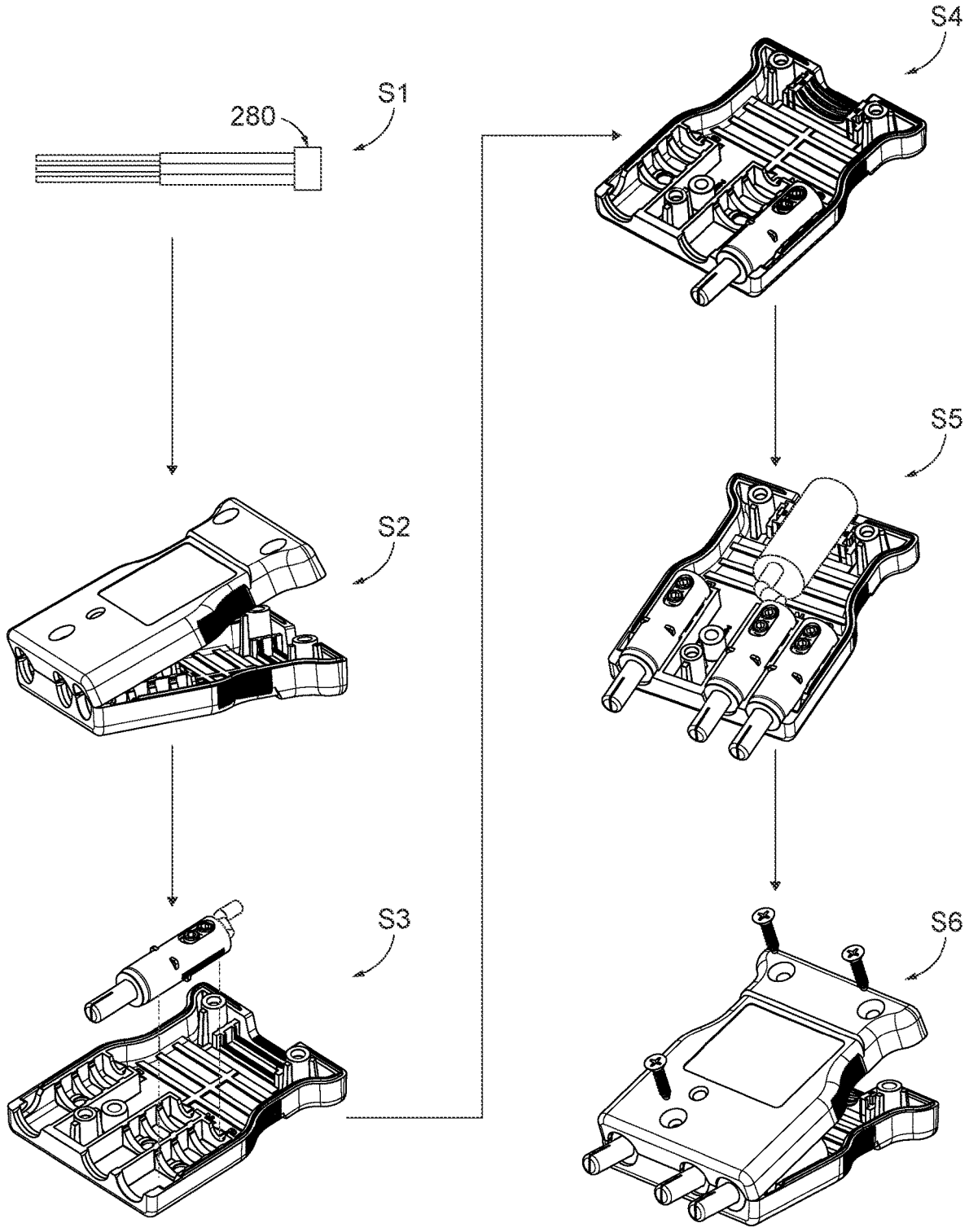
FIG. 31 is a flow chart showing an exemplary assembly method of a stage pin connector.

FIG. 31 shows an exemplary flow chart for assembling the electrical connector 210. A cable 290 can be stripped of an outer layer to expose the ground, neutral, and line conductors, and the conductors are stripped to remove a portion of the insulation layers (S1). The housing members 224, 226 are separated by pivoting and separating the latch member 231 from the pocket 233 (S2). The stripped wires from the cable 290 can be inserted into ferrules 286 and then inserted into the assembled contact 220 and sleeve 222 combination, or the wires can be directly inserted into the contact 220 and sleeve 222 (S3). The set screws 284 are used to retain the wires in the contacts 220. The wired contact 220 and sleeve 222 is then press-fit into the first housing member 224, with the cylindrical projections 272 aligned with the depressions 247 (S3). One or more of the strain relief members 218 are connected to one or both of the housing members 224, 226 (S4). Depending on the size of the cable 290, different sized strain relief members are used. Also, one or two strain relief members 218 can be used depending on the size of the cable 290. For example, a first strain relief member 218 is connected to the first housing member 224 and a second strain relief member 218 is connected to the second housing member 226, or only a single strain relief member can be connected to either the first or second housing members 224, 226. The cable 290 is then placed in the strain relief member 218 (S5). The housing members 224, 226 are then connected together using the pivoting connection and secured to one another with the mounting screws 282 (S6). These steps (S1-S6) need not be performed in any specific order.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present invention, and are not intended to limit the structure of the exemplary embodiments of the present invention to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed is:

1. An electrical connector comprising: a first housing member having a first conductor opening and a plurality of first contact portions, wherein each the first contact portions are defined by a top wall, a bottom wall, and at least one side wall; a second housing member having a second conductor opening and a plurality of second contact portions, wherein the second housing member is releasably connected to the first housing member and the plurality of second contact portions align with the first contact portions when the first housing member is connected to the second housing member; a cylindrical sleeve including a body having an outer surface and an inner surface, the sleeve releasably received in at least one of the first contact portions by an interference fit; and a contact member releasably received in the sleeve; wherein a first set of projections extends from the sleeve body, and a second set of projections extends from the sleeve body, wherein the first set of projections are spaced radially and axially offset from the second set of projections.

2. The electrical connector of claim 1, wherein the sleeve includes a cylindrical projection extending from the body, and wherein at least one of the first contact portions includes a depression receiving the cylindrical projection.

3. The electrical connector of claim 1, wherein the sleeve is configured to receive a male contact pin or a female contact sleeve as the contact member.

4. The electrical connector of claim 1, wherein the first housing member includes a curved projection and the second housing member includes a curved depression configured to pivotally receive the curved projection.

5. The electrical connector of claim 1, wherein the housing and the sleeve are made from a non-conductive material and the contact is made from a conductive material.

6. The electrical connector of claim 1, wherein the body includes an opening positioned to align with a set screw of the contact member.

7. The electrical connector of claim 1, wherein the body includes a front end that engages the top wall and a back end that engages the bottom wall.

8. The electrical connector of claim 1, wherein the interference fit is formed between the body and the side wall.

9. The electrical connector of claim 1, wherein each first contact portion of the plurality of first contact portions is aligned with a respective one of the plurality of second contact portions to form a closed-perimeter opening through which the contact member is received.

10. The electrical connector of claim 1, wherein the sleeve includes a nose having a frusto-conical shape configured to engage a frusto-conical region of at least one of the first contact portions to form the interference fit.

11. The electrical connector of claim 1, wherein the first housing member includes a first end and a second end opposite of the first end, and wherein the first conductor opening is disposed at the first end and the plurality of first contact portions are disposed at the second end.

12. An electrical connector comprising: a first housing member having a first conductor opening and a plurality of first contact portions, wherein each the first contact portions are defined by a top wall, a bottom wall, and at least one side wall; a second housing member having a second conductor opening and a plurality of second contact portions, wherein the second housing member is releasably connected to the first housing member and the plurality of second contact portions align with the first contact portions when the first housing member is connected to the second housing member; a cylindrical sleeve including a body having an outer surface and an inner surface, the sleeve releasably received in at least one of the first contact portions by an interference fit; and a contact member releasably received in the sleeve, wherein the contact member is one of a male contact member and a female contact member and the sleeve is configured to releasably receive either the male contact member or the female contact member; wherein a first set of projections extends from the sleeve body, and a second set of projections extends from the sleeve body, wherein the first set of projections are spaced radially and axially offset from the second set of projections.

13. The electrical connector of claim 12, wherein one of the first and second housing members includes a protrusion extending into the contact portion and wherein the sleeve includes a rib extending from the outer surface of the body.

14. The electrical connector of claim 12, wherein the first housing member includes a strain relief retainer, and wherein a strain relief member is connected to the strain relief retainer.

15. The electrical connector of claim 12, wherein the contact includes a set screw configured to retain a cable inserted into the contact and the sleeve body has an opening aligned with the set screw.

16. The electrical connector of claim 12, wherein the body includes a nose having a tapered configuration, and wherein at least one of the top walls has a tapered portion mating with the tapered configuration of the nose.

17. The electrical connector of claim 12, wherein each first contact portion of the plurality of first contact portions is aligned with a respective one of the plurality of second contact portions to form a closed-perimeter opening through which the contact member is received.

18. The electrical connector of claim 12, wherein the first housing member includes a first end and a second end opposite of the first end, and wherein the first conductor opening is disposed at the first end and the plurality of first contact portions are disposed at the second end.

* * * * *